United States Patent [19]

Chesneau et al.

[11] 4,001,832

[45] Jan. 4, 1977

[54] VERTICAL ANTENNA HAVING AN OFF-CENTER SUPPLY

[75] Inventors: René Chesneau; Jean-Marc Martin, both of Paris, France

[73] Assignee: Thomson-CSF, Paris, France

[22] Filed: Oct. 2, 1975

[21] Appl. No.: 619,038

[30] Foreign Application Priority Data

Oct. 4, 1974 France ..... 74.33529

[52] U.S. Cl. ..... 343/747; 343/749; 343/875

[51] Int. Cl.[2] ..... H01Q 9/16; H01Q 9/34

[58] Field of Search ..... 343/845, 846, 874, 875

[56] References Cited

UNITED STATES PATENTS

| | | | |
|---|---|---|---|
| 2,118,429 | 5/1938 | Duttera | 343/875 |
| 2,153,768 | 4/1939 | Morrison | 343/874 |
| 2,875,443 | 2/1959 | Kandoian | 343/749 |

*Primary Examiner*—Eli Lieberman

*Attorney, Agent, or Firm*—Cushman, Darby & Cushman

[57] ABSTRACT

A vertical grounded antenna is supplied at one third of its height. The antenna is substantially a whole wave antenna and, in order to reduce the secondary lobes of the vertical pattern of said antenna, its height is so determined as to produce an inversion of the sign of the phase of the current on each side of the feed input.

3 Claims, 5 Drawing Figures

VERTICAL ANTENNA HAVING AN OFF-CENTER SUPPLY

The present invention relates to a vertical antenna supplied at substantially one third of its height.

Such antennas are employed in hectometric wave broadcasting. These antennas have vertical radiation patterns which have relatively large secondary lobes, which is disadvantageous owing to the interferences which may result.

An object of the present invention is to avoid this drawback.

According to the invention, there is provided a vertical antenna having a feed input at substantially one third of its height, said height being substantially equal to 0.9 λ, where λ is the wavelength corresponding to its operational frequency.

The invention will be better understood, and further features will be apparent, from the ensuing description with reference to the accompanying drawing in which:

In these figures, corresponding elements are designated by the same references.

FIG. 1 shows a whole wave antenna 1 whose base is directly connected to the ground and which is supplied, substantially at one third of its height by a generator 4.

This antenna, which forms a thin dipole, comprise two radiating parts 2 and 3 placed end-to-end and separated by an insulator 20 at the terminals of which the generator 4 is connected. With a generator thus positioned the height of the antenna is usually equal to three quarters of its operational wavelength λ, corresponding to the frequency of the generator 4.

In the present case, this height is greater since it is slightly less than the operational wavelength λ.

Figure 1:
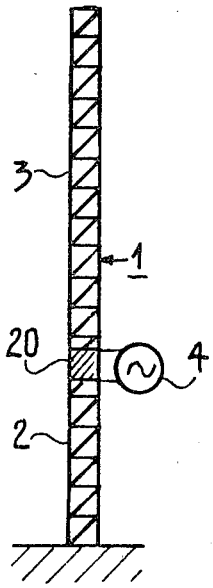
FIG. 1 is a diagrammatic view of an embodiment of an antenna according to the invention.

This unusual length of the antenna shown in FIG. 1 will be explained by FIGS. 2 and 3.

Figure 2:
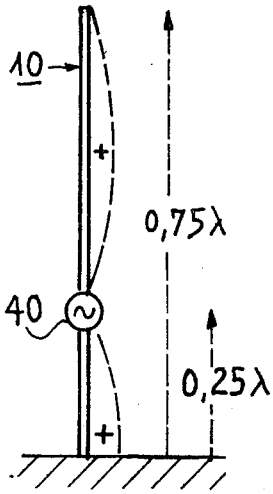
FIGS. 2 and 3 are diagrammatic views of the distribution of the phases of the currents on 0.75 λ and 0.9 λ antennas having an eccentric supply.

FIG. 2 shows an antenna 10 of the height of 0.75 λ whose base is directly connected to the ground and which is supplied at a height of 0.25 λ by a generator 40. As indicated in dotted lines in the figure, the phase of the current always has the same sign at a given instant, along this antenna and the generator 40 is disposed at a current node.

Experience shows and theoretical considerations confirm, that in order to reduce the secondary lobes of the vertical pattern of such an antenna, the sign of the current phase must be inverted on each side of the point where the antenna is supplied.

Figure 3:
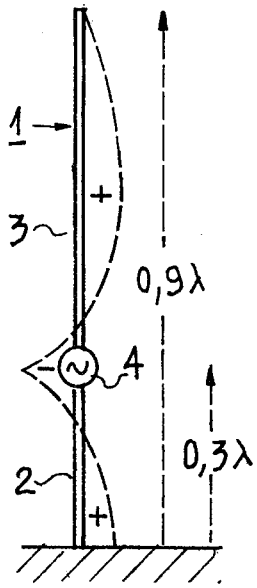

This is illustrated in FIG. 3 which represents an antenna which differs from the antenna shown in FIG. 2 to the greater length of the radiating parts 2 and 3 of the antenna : part 2 being 0.3 λ high and antenna being 0.9 λ high. This results in an inversion of the sign of the phase of the current in the antenna on each side of the region in which the antenna is supplied by the generator 4.

Figure 4:
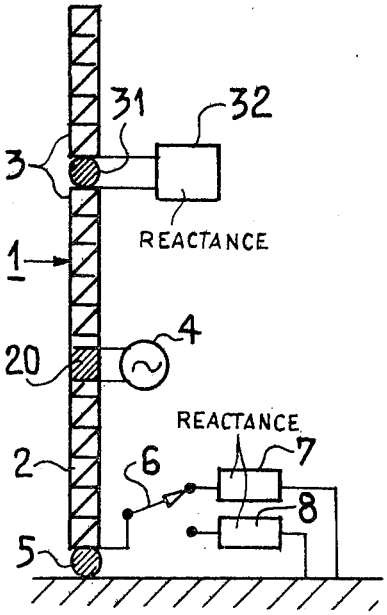
FIGS. 4 and 5 are two particular embodiments of an antenna according to the invention.

FIG. 4 represents a whole wave antenna 1 placed on an insulating support 5, bearing on the ground, and supplied substantially at one third of its height by a generator 4.

A switch 6 permits connecting the base of the antenna to ground either through a reactance 7 or through a reactance 8; it being possible to reduce one of these two reactants to a simple short-circuit. The function of the device comprising the elements 6 to 8 is to permit:

in the day time, operation with the base of the antenna connected to ground through a low impedance and thereby obtain, with small secondary lobes, a gain of 2 to 3 dB over the conventional half-wave dipole on the ground;

at night, uniting the base of the antenna with the ground through a high impedance the vertical radiation pattern of the antenna facilitating transmission of the waves by reflection on the inonosphere, FIG. 4 also shows that the upper radiating part 3 of the antenna is divided, the two parts being interconnected by an insulator 31. A reactance 32 is inserted in the radiating part 3 in the region where it is divided. The position of the reactance 32 and its value are so determined as to render the results obtained with the antenna optimal or to enable the antenna to be tuned within a certain frequency range.

Figure 5:
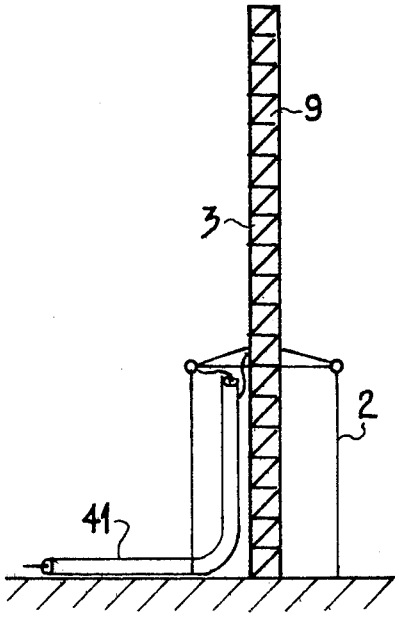

FIG. 5 shows diagrammatically and in section an embodiment of the antenna according to the invention in which a pylon 9 is employed in the first third of its height, only as a support for a cylindrical group of parallel, vertical wires 2. On the remainder of its height, the pylon is employed as a radiating element 3. This antenna is supplied by means of a coaxial supply cable 41 which extends along the pylon 9 in the first third of its height, the inner conductor thereof being connected to the top of the group of wires whereas the outer conductor is connected to the pylon 9 substantially at one third of the height of the latter.

No mention has been made in the foregoing of the fixing of the pylons, but is will be understood that they may be self-supporting or supported by guys.

By way of a modification of the embodiments described, the part of the antenna located above the supply point may be shortened by the use of an end capacity mounted at the top of the antenna.

With the antennas according to the invention, it is possible to reduce the secondary lobes to a level of −20dB from an angle of elevation of 35° to zenith (90°).

An antenna according to the invention is of particular utility in an array of antennas having a directional pattern in azimuth.

Of course, the invention is not limited to the embodiments described and shown which were given solely by way of example.

What is claimed is:

1. A vertical antenna having an insulator at substantially one third of its height and a feed input comprising two terminals, said terminals being separated by said insulator, said height being substantially equal to 0.9λ, where λ is the wavelength corresponding to its operational frequency, in order to produce an inversion of the sign of the phase of the current above and under said feed input.

2. A vertical antenna as claimed in claim 1, comprising a low impedance, a high impedance and a switch for connecting the base of the antenna to the ground, either through said low impedance for operation with an inversion of sign of the phase of the current on each side of said feed input so as to reduce the secondary lobes, or through said high impedance so as to obtain a vertical pattern facilitating a propagation by ionospheric waves.

3. A vertical antenna as claimed in claim 1, comprising a tuning impedance inserted in said antenna above said feed input.

* * * * *